US005291827A

United States Patent [19]

Liers et al.

[11] Patent Number: 5,291,827

[45] Date of Patent: * Mar. 8, 1994

[54] PROCESS AND APPARATUS FOR THE ULTRASONIC CLEANING OF A PRINTING CYLINDER

[75] Inventors: Arthur H. Liers, Smithtown; Louis J. Principe, Deer Park; James Lagonigro, North Massapequa, all of N.Y.

[73] Assignee: Sonicor Instrument Corporation, Copiague, N.Y.

[ * ] Notice: The portion of the term of this patent subsequent to Oct. 22, 2008 has been disclaimed.

[21] Appl. No.: 835,777

[22] Filed: Feb. 14, 1992

Related U.S. Application Data

[63] Continuation-in-part of Ser. No. 781,699, Oct. 19, 1991, Pat. No. 5,240,506, which is a continuation of Ser. No. 328,953, Mar. 27, 1989, Pat. No. 5,058,611.

[51] Int. Cl.[5] ..... B41F 35/00

[52] U.S. Cl. ..... 101/424; 101/425

[58] Field of Search ..... 101/424, 423, 425; 134/105, 184

[56] References Cited

U.S. PATENT DOCUMENTS

| | | | |
|---|---|---|---|
| 3,040,754 | 6/1962 | Lear, Sr. | 134/149 |
| 4,311,157 | 1/1982 | Jubenville et al. | 134/184 |
| 4,372,787 | 2/1983 | Fields et al. | 134/184 |
| 4,705,054 | 11/1987 | Fields | 134/184 |
| 5,088,510 | 2/1992 | Bannon | 134/105 |

OTHER PUBLICATIONS

Sale Flier for Sonicor, Model No. Cu-9610 HTFR.

Exhibit A: Invoice for Sonicor Ultrasonic Cleaning System CU-9616 HTFR-43, dated Mar. 30, 1988.

Exhibit B: Invoice for Sonicor Ultrasonic Cleaning Console CU-9310A, dated Dec. 3, 1986.

Exhibit C: Invoice for Sonicor Ultrasonic Cleaning System CU-9810A, dated Dec. 4, 1986.

Exhibit E: Invoice for Sonicor Ultrasonic Cleaning System UC-10314 HFTLL-43, dated Nov. 5, 1987.

Exhibit F: Invoice for Sonicor Ultasonic Cleaning System CU-9610 HTFR, dated Aug. 14, 1987.

Exhibit G: Invoice for Sonicor Ultrasonic Cleaning System CU-4808 HTFR, dated Feb. 11, 1988.

Exhibit H: *American Printer*, p. 153, Jun. 1987.

Exhibit I: *Packaging Printing & Converting*, p. 74, Dec. 1988.

Exhibit J: *Gravure Association of America*, Mar. 28, 1988.

*Primary Examiner*—Edgar S. Burr
*Assistant Examiner*—Anthony H. Ngyen
*Attorney, Agent, or Firm*—Collard & Roe

[57] ABSTRACT

A process and apparatus for carrying out the ultrasonic cleaning of printing cylinders of various sizes, including a cleaning tank which contains a liquid cleaning detergent into which the printing cylinder to be cleaned is immersed. Heaters are also included for heating and maintaining the temperature of the cleaning liquid at a temperature below 185° F., preferably within the range of 110-160° F. while the printing cylinder is cleaned. The cleaning of the printing cylinder within the cleaning tank of the apparatus is carried out by ultrasonic waves which are generated and radiated throughout the cleaning liquid for a period of time, generally, between 5-30 minutes. In a preferred embodiment of the apparatus and process, the printing cylinder is continually rotated within the cleaning tank during the period of time when the ultrasonic waves are radiating through the cleaning liquid. Adjusting means are employed so that various-sized cylinders can all be maintained an optimal distance from the transducers.

16 Claims, 7 Drawing Sheets

PROCESS AND APPARATUS FOR THE ULTRASONIC CLEANING OF A PRINTING CYLINDER

CROSS-REFERENCE TO RELATED APPLICATION

This application is a continuation-in-part of co-pending application, Ser. No. 07/781,699, filed Oct. 21, 1991; now U.S. Pat. No. 5,240,506 issued Aug. 31, 1993, which, in turn, is a continuation of application Ser. No. 07/328,953, filed Mar. 27, 1989, which matured into U.S. Pat. No. 5,058,611, on Oct. 22, 1991.

BACKGROUND OF THE INVENTION

1. Field of the Invention

The present invention relates generally to a process and apparatus for the ultrasonic cleaning of a cylinder used in a printing press.

More particularly, the present invention provides for the ultrasonic cleaning of a printing cylinder employing rational means for, preferably, the continuous rotation of a printing cylinder in a chamber while exposing such cylinder to sound waves having a frequency which, preferably, is in the range of 20–29 kHz for a period of time which would generally be less than 30 minutes. The means for rotation of the printing cylinder may be either magnetic or non-magnetic; the latter means being preferred. The ultrasonic cleaning of printing cylinders according to the present invention would preferably be carried out in a water-based chemical environment.

2. The Prior Art

Heretofore, the removal of ink residues from engraved printing cylinders has always been a labor-intensive activity which has often yielded less-than-acceptable results. Moreover, if the inks on the printing cylinders were not removed almost immediately from the cylinders and, instead, were allowed to dry, the cleaning of such cylinders became far more difficult, if not impossible. The complete removal of the inks was not always accomplished, resulting in problems concerning the level of the quality of the print obtained when the cylinder was re-used.

In addition to the limited effectiveness of prior processes and means for cleaning printing cylinders, the typical inks which have been used by the printing industry have required a cleaning solution using a toxic, or otherwise flammable, organic solvent base. Such solvents have included, for example, acetone, methyl ethyl ketone and trichloroethane, well as various alcohols. The health hazards to personnel working with such chemical cleaning solutions on a day-to-day basis, as well as problems of safe and legal waste disposal, are well known within the industry.

The recognized, and heretofore unfulfilled, need within the printing industry for alternative safe and effective means for the cleaning of printing cylinders has continuously grown more critical. During the past few years, safety and environmental concerns have become far more acute as the U.S. Environmental Protection Agency and OSHA, as well as various state and local agencies, have begun to strictly enforce laws and regulations governing the safe disposal and use of such potentially hazardous chemical agents.

By way of further background, one solution which has been attempted in order to overcome the foregoing health and safety concerns was the development of water-based inks as a replacement for the organically-based inks in use. Such water-based inks could, conceivably, be cleaned from the printing cylinders with cleaners having water-based solvents which could be handled and disposed of, along with the water-based inks used, in compliance with applicable health and safety requirements. When water-based inks were introduced, more and more printers began to switch to the use of such inks. This cured the problem of the safe and lawful disposal of the inks. However, it was soon realized that once the water-based inks dried on the printing cylinder and other parts of the printing presses used, they became extremely difficult to remove by conventional means.

In one sector of the trade, known as flexographic printing, the printing cylinder was coated with a ceramic. The ceramic would be coated onto the cylinder in a molten form via a process known as plasma coating. The desired printing pattern is then etched into the ceramic using a laser, with the ink cells created by the laser etching. These cells are often too small to be seen with the unaided eye. Laser etchings generally have a length, width and depth in the range of 10–40 microns. Thus, ink which had been dry within these cells became almost impossible to remove.

Cleaning methods, such as high pressure water sprays, soaking and scrubbing with wire brushes, and the use of numerous harsh chemical agents, were all employed in various, less-than-satisfactory attempts to remove such inks. Labor costs were excessive and the result, in most cases, was a residue of dried ink in the cylinder cells, causing an improper printing, and the need to shut down the printing presses from time to time and adjust ink volumes or replace the entire printing cylinder with another. Large inventories of cylinders had to be retained in order to deal with this problem and, in many cases, printing cylinders thought to be defective were returned to suppliers for stripping, recoating and engraving at very high costs when, in actuality, such procedures were unnecessary: the printing cylinders were merely contaminated with ink trapped in the cells of the cylinders.

The use of ultrasonic energy as a procedure for cleaning a radiator having a header has been disclosed by Fields et al. in U.S. Pat. No. 4,372,787, issued Feb. 8, 1983. Nevertheless, the potential benefits of using ultrasonic procedures in the unrelated art of cleaning printing cylinders, in order to overcome the drawbacks otherwise inherent when using organic or water-based inks, as detailed above, were never recognized by the printing industry. This was the fact that there was a widespread recognition that existing methods of effecting the cleaning of printing cylinders were time-consuming, labor-intensive, not particularly effective, and often hazardous from a health and safety standpoint.

SUMMARY OF THE INVENTION

It is therefore an object of the present invention to provide a method and apparatus employing ultrasonic energy to remove residual ink from the printing cylinders of printing presses.

It is a further object of the present invention to provide a method and apparatus for the uniform cleaning of printing cylinders using ultrasonics which is less time-consuming and more economical than currently employed procedures.

It is yet another object of the present invention to provide a method and apparatus for the uniform cleaning of printing cylinders with different diameters.

It is still a further object of the present invention to provide a method and apparatus for the uniform cleaning of printing cylinders using ultrasonics which is safe from both a health and environmental standpoint.

The foregoing and related objects are achieved by an apparatus which introduces ultrasonic waves into a tank having a cleaning liquid in which a printing cylinder to be cleaned can be immersed. The tank may be constructed out of a variety of materials depending, in part, upon the type of cleaning liquid employed. Such materials include, for example, stainless steel. The dimensions of the cleaning, or ultrasonics, tank to be used for the purpose of cleaning a printing cylinder are preferably 96" LR×10" FB×19" D and having a tank capacity of 70 gallons. It should, of course, be recognized that modifications of the foregoing dimensions are, of course, possible and should be considered within the scope of the present invention.

The apparatus of the invention would preferably include means for rotating the printing cylinder in the tank. When the printing cylinder is rotated during introduction of the ultrasonic waves, a continuous and even cleaning of the cylinder from ink and other residue is achieved. The rotation may either be carried out via magnetic or non-magnetic rotational means. Testing has established that non-magnetic rotational means are more efficient and much preferred.

The apparatus of the invention may advantageously include adjusting means which can maintain the proper distance from the printing cylinder to the source of the ultrasonic waves. In this manner, various-sized cylinders can be effectively cleaned by a single apparatus.

The ultrasonic waves used for cleaning should have a sufficient amplitude to cause microscopic voids, or "bubbles," to form throughout a cleaning liquid contained within a cleaning tank. The cleaning liquid is permeated with ultra-high frequency electrical energy which is fed to a converter and changed into mechanical energy by, e.g., a lead-zirconate-titante transducer, piezoelectric-Izt-sandwich construction-type transducer, etc. A series of transducers are preferably mounted on the bottom of the cleaning tank. Subsequent compression portions within the ultrasonic waves cause the voids or bubbles produced by the waves as they collapse at high-intensity levels, thereby creating shock waves which radiate from the nuclei of such voids. In ultrasonic cleaning, this phenomena, known as "cavitation," literally causes a ripping of contaminants from both the surface of the printing cylinder, as well as the most minute recesses of parts of the cylinder immersed in the cleaning liquid.

The ultrasonic cleaning of printing cylinders by way of the present invention is preferably carried out at a frequency range of greater than 20 kHz, preferably in the range of 25–29 kHz, most preferably at about 27 kHz, for between a period of time of 5–30 minutes. It should be recognized that a frequency which is too high will result in a poor cleaning, or excessively long cleaning times, whereas a frequency which is too low may result in cylinders which are only partially cleaned due to a pronounced "banding" of ultrasonic cavitation at the low end of the frequency range.

The ultrasonic cleaning of printing cylinders, according to the present invention, literally causes millions of cavitation bubbles to form and collapse at speeds of anywhere from 20 to 100,000 times per second. It should be recognized that although the engraved cells that hold the ink on the cylinder are themselves of microscopic size, i.e., having dimensions on the order of 10–40 microns, such cells are easily penetrated by cavitation and thus, ink residues can be removed throughout the entire cells with greater effectiveness than would otherwise be possible with presently known, manual methods.

It has been determined that, in most cases, even when printing inks have been allowed to dry, that ultrasonic cleaning successfully and completely removes the dried ink residue within 30 minutes. Thus, chrome-plated gravure cylinders can generally be cleaned in ten minutes or less. In all such instances, no manual labor is required during the cleaning process other than the labor needed to activate the means necessary to place the printing cylinder into the cleaning tank, and later remove it following the cleaning process. By naming the ultrasonic cleaning of printing cylinders in accordance with the present invention, following a printing job, cylinders may be removed from the printing press, placed in a cleaning tank of the present invention, cleaned, usually, in under 30 minutes and immediately thereafter placed back on a printing press for use on a new job.

The cleaning solution employed in combination with the present invention should, preferably, be an alkaline aqueous-based solution, which is preferably biodegradable. Therefore, the solution is capable of a safe and legal disposal so as to avoid the problems generally associated with non-aqueous based, or organic, cleaning solvents. The cleaning chemical may generally contain synthetic detergents, chelates and wetting agents, along with other additives which may perform other specific functions in the cleaning process.

The temperature of the cleaning solution during the ultrasonic cleaning of the printing cylinders should preferably be between 110°–160° F. depending, to some extent, upon the chemical composition of the cleaning agent. This is because it has been discovered that the cavitation levels during cleaning reach their optimum level within the foregoing temperature range. Temperatures in excess of 185° F., by contrast, generally result in a sharp reduction in the level of ultrasonic cavitation.

To ensure a proper ultrasonic cleaning of the printer cylinder within the ultrasonic tank, both the ultrasonic frequency, as briefly discussed above, and the power level within the cleaning tank are important. The ultrasonic power is, preferably, approximately 2,400 watts; the frequency is preferably about 27 kHz.

As will be explained in greater detail with reference being made to the accompanying drawings, an adjustable pillow block is preferably used within the ultrasonic tank as a means for supporting the printing cylinder being cleaned. While being cleaned, the printing cylinder is preferably rotated continuously at a speed which is, preferably, between 1–4 rpm.

Other objects and features of the present invention will become apparent and will be discussed below in combination with a description of the accompanying drawing figures. It should, of course, be recognized that the accompanying drawings are intended solely for purpose of illustration and are not intended as a means for defining the limits and scope of the present invention.

BRIEF DESCRIPTION OF THE DRAWINGS

Other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
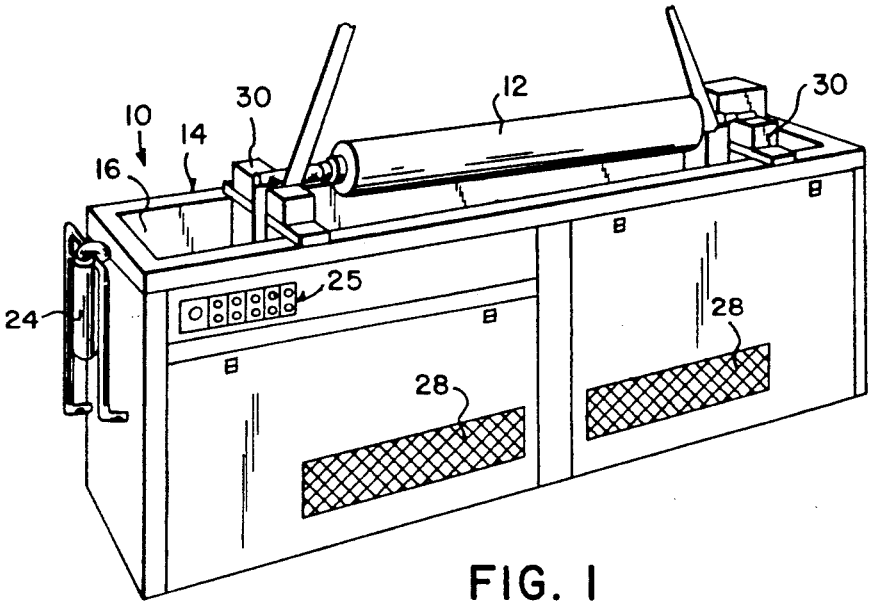
FIG. 1 is a perspective overview of the ultrasonic cleaning apparatus of the present invention with a printing cylinder shown atop the cleaning apparatus prior to its placement within said apparatus.

Turning now in detail to the drawings, and in particular, FIG. 1, there is shown a perspective view of a preferred embodiment of the ultrasonic cleaning apparatus 10 with a printing cylinder 12 being suspended above apparatus 10 prior to placement of cylinder 12 in the ultrasonic tank 14.

Ultrasonic cleaning tank 14 is preferably made of stainless steel, preferably "300 series" stainless steel. Such a construction is preferred in order to prevent rust and chemical corrosion. Tank 14 is preferably constructed so that its walls 16, which define the length of tank 14, are maintained at a distance of from two inches to four inches from the face of cylinder 12 in order to focus maximum ultrasonic power against the face of the cylinder. It has been discovered during testing that, although cylinders 12 may be cleaned using greater distances between walls 16 of tank 14 and the face of the printing cylinder, the time period necessary for cleaning the cylinder is increased, thereby causing a loss of efficiency in the cleaning process.

This also holds true if the distance of the surface of the printing cylinder is increased from the radiating source of the ultrasonic waves. The distance between the ultrasonic energy source and the surface of the printing cylinder should, preferably, be maintained at from three to five inches. If the distance between the radiating energy source and the printing cylinder surface is not maintained within this range, particularly, if it is greater than five inches, it has been discovered that the time cycle necessary for performing the cleaning is adversely affected due to a loss of ultrasonic energy. Additionally, a distance of less than three inches between the source of the ultrasonic energy and the face of the printing cylinder being cleaned would, adversely, cause ultrasonic radiation to reflect back to the transducers, which initially act to radiate the sound waves into the cleaning liquid. This "reflecting back" of ultrasonic radiation to the transducers of the apparatus can cause electrical spiking to occur in the generator circuits, severely etch the radiating surface, and tend to trap the ultrasonic radiation within the narrow distance between the source of the radiation and the printing cylinder surface, thereby reducing the overall efficiency of the cleaning procedure throughout the remainder of the cleaning tank.

Figure 2:
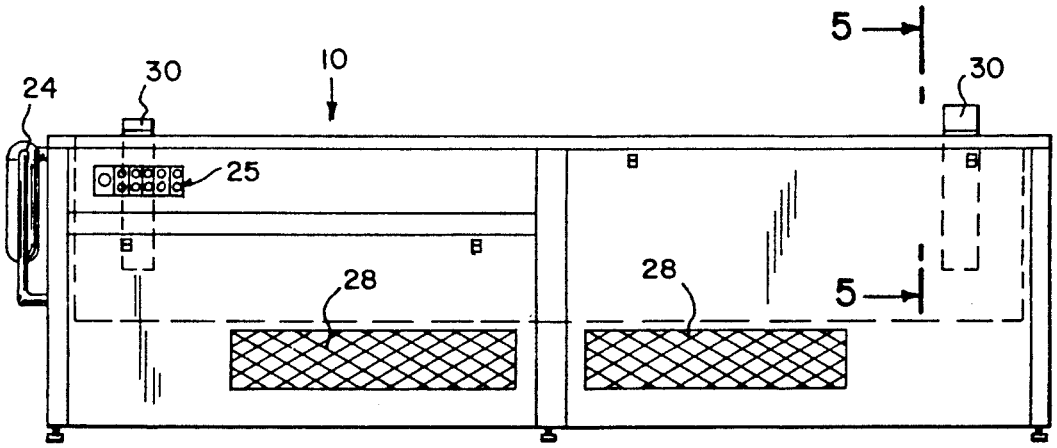
FIG. 2 is a side view, in elevation, of the ultrasonic cleaning apparatus of FIG. 1.
Figure 3:
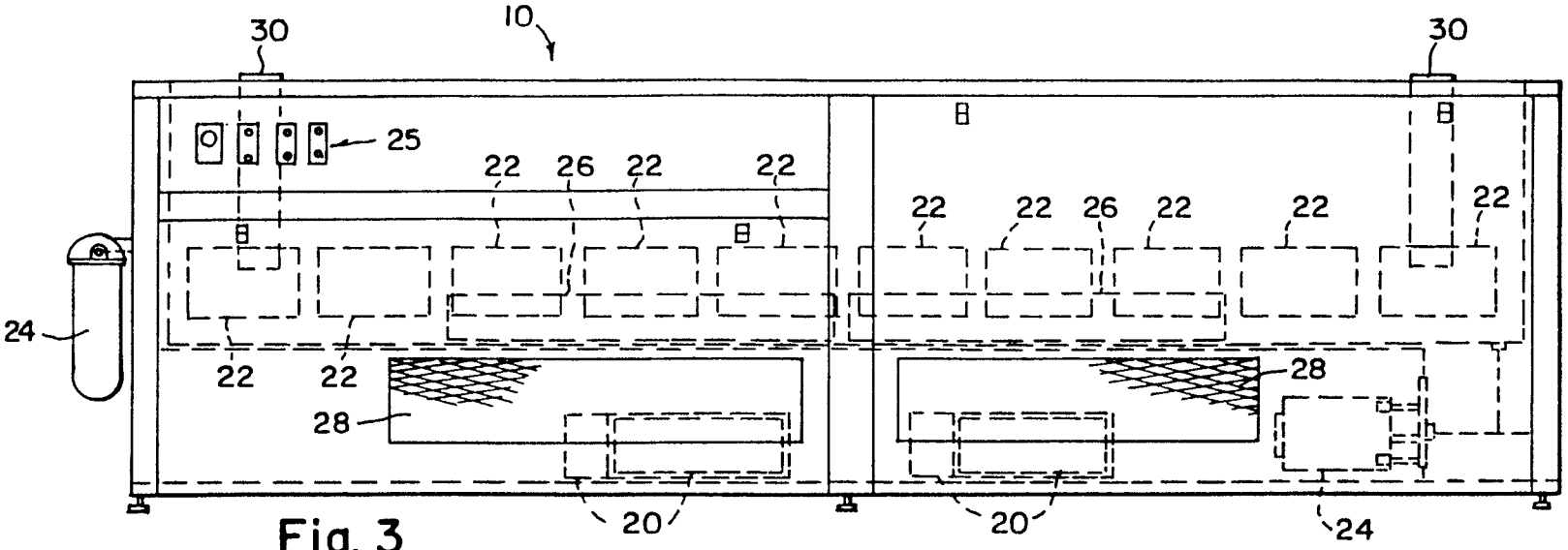
FIG. 3 is a detailed side view, in elevation, of a preferred embodiment of the cleaning apparatus of FIG. 2.
Figure 4:
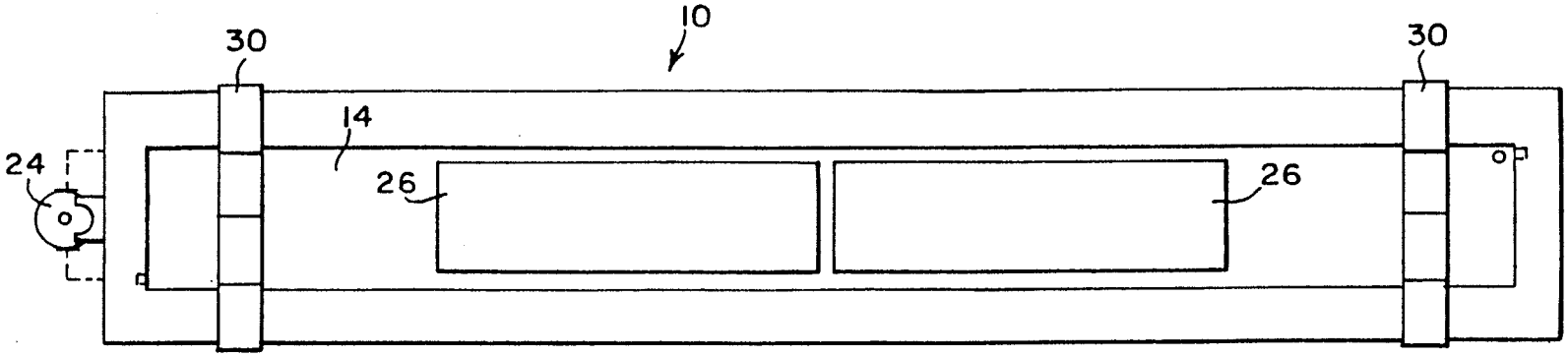
FIG. 4 is a top view of the preferred embodiment of the cleaning apparatus of FIG. 2.

FIGS. 2 and 3 present side views of a preferred embodiment of cleaning apparatus 10 of the present invention, with FIG. 3 showing, in phantom, the internal features of the apparatus. Apparatus 10 includes one or more ultrasonic wave radiating units 26, which are preferably designed to immerse within tank 14. Ultrasonic radiating units 26 are preferably mounted either in the bottom of tank 14, on one side wall, or on both side walls 16 of the tank. Radiating units 26 are preferably designed so that their lengths are approximately equal to the length of the surface of a conventional printing cylinder 12, which is to eventually be cleaned in apparatus 10. The journals, or shafts, at either end of conventional printing cylinders do not ordinarily require cleaning and, in any event, are not difficult to clean via conventional means when desirable.

Testing has indicated that ultrasonic wave frequencies should generally be at least 20 kHz, preferably between 25–29 kHz, and most preferably, approximately 27 kHz, though frequencies as great as 40 kHz may also be utilized. Experience has shown that the lower the frequency of the ultrasonic waves, the more intense the ultrasonic waves are to produce intense cavitation, which speeds along the cleaning process. Higher frequencies, such as those of 40 kHz or greater, have a tendency to produce less intense cavitation. If the cavitation is less intense it will take a greater period of time to perform the cleaning function. While the difference in cleaning times would generally be only a matter of a few minutes, when a large volume of cleaning is required, the distinction is cleaning time may become significant.

Power outputs to ultrasonic wave radiating units 26, which are preferably immersed in the cleaning liquid, were found to be most effective when such immersible units produced a power output level of approximately 5–6 watts per square inch of immersible irradiating surface. Power levels lower than this preferred range were found to increase the cleaning time unnecessarily, while higher power levels were found to increase the cost of operating the apparatus. Moreover, power levels which are too high can cause a cavitation barrier to form on the ultrasonic radiating surface. Severe erosion of the irradiating surface could also occur at power levels which are too high, along with the possibility that the print cycles could be damaged, including a chrome plating over copper or other types of metallic bases.

As previously alluded to, the immersed ultrasonic wave generating units 26 are preferably designed so that the width of the irradiating surface of such units is substantially equal to the diameter of the surface of the printing cylinder to be cleaned. The length of the irradiating surface of the ultrasonic wave generating units 26 is, preferably, substantially equal to, or greater than, the length of the cylinder surface. This preferred construction is designed to create a focused type of ultrasonic field which provides intense and evenly-distributed cavitation against the cylinder surface of printing cylinder 12 as the printing cylinder is preferably rotated in the ultrasonic field, within the cleaning tank.

Based upon the preferred design of the irradiating surfaces of the ultrasonic wave generating units, and the preferred output level of power, it is projected that the total ultrasonic power of apparatus 10 would be approximately 2,400 watts.

Referring, further, to FIG. 3, tank 14 is equipped with one or more heating units 22 in order to maintain the cleaning solution (which is to be discussed in further detail hereinafter) at a temperature which is effective for carrying out the ultrasonic cleaning procedure. The heating units are, preferably, 8-kilowatt units and controlled via a thermostat. The temperature of the cleaning solution should preferably be maintained within the range of 110°–160° F., depending upon the type of cleaning solution employed, and should generally not exceed 185° F. The proper temperature for the cleaning solution is important, both with respect to the effectiveness of the chemical cleaning solution employed and, additionally, with respect to maximizing the production of ultrasonic cavitation.

As an option, tank 14 is further provided with a filtering system 24, which includes a means for recirculating the cleaning solution employed in tank 14, in order to remove particulate matter from the cleaning solution and thereby prolong its effectiveness, as well as to prevent excessive contamination from a reducing formation of ultrasonic cavitation. The filter should preferably have pores sized between 5–50 microns, most preferably about 20 microns.

Tank 14 is also preferably equipped with a drain and inlet water fittings (not shown) for ease of use. The tank solution may either be gravity-drained or pumped from cleaning tank 14. Water may also be pumped into the unit to facilitate the filling of the cleaning tank. An overflow outlet is also, preferably, provided in order to prevent an accidental spill due to the overfilling of the cleaning tank. In a preferred embodiment of the invention, it is further recommended that a conventional low-level liquid sensor be installed as a means for preventing damage to the ultrasonic wave radiating units 20, immersed in the cleaning solution, and the heating units 22, should the cleaning liquid level drop below a pre-determined level.

Control of low-level sensors, as well as thermostatic means for regulating the temperature of the cleaning solution within tank 14, and means for regulation of the time of the ultrasonic cleaning procedure, may be carried out via conventional controls, designated by reference numeral 25.

FIG. 3 further shows, in a phantom, the location of transducers 26 for radiation of the ultrasonic sound wave into the cleaning liquid within tank 14. Transducers 26 preferably have a piezoelectric-Izt-sandwich construction, though, clearly, it should be understood that a wide variety of transducers may be employed in combination with the inventive apparatus. In the preferred embodiment illustrated in the drawing figures, reference numeral 28 refers to heat exhaust means of apparatus 10.

The chemical cleaning solution employed in the ultrasonic cleaning process of the present invention is, preferably, a biodegradable alkaline detergent solution, which, more particularly, is preferably composed of alkaline phosphates, wetting agents and amines (e.g., 5–10% by volume, mono-ethanol amine) in a water base. One such cleaning solution is sold under the trademark "#116 SONICOR SONIC-STRIP" and is commercially available from Sonicor Instrument Corporation, 100 Wartburg Avenue, Copiague, N.Y. 11726, U.S.A. The chemical cleaning agent employed should be capable of dissolving, or otherwise breaking up, oils, grease, light carbon, as well as many other organic and inorganic contaminants when combined with ultrasonic cavitation.

Apparatus 10 preferably includes positioning fixture 30, with a feeder mechanism, which acts as a means for guiding printing cylinder 12 into tank 14 when the user wishes to clean a printer cylinder. Positioning fixture 30 is preferably made of stainless steel and has a "V"-block arrangement. Once the printing cylinder is within the cleaning tank of the apparatus, in order to clean the cylinder quickly and evenly over the entire print face, printing cylinder 12 should be rotated through the cavitation field within the cleaning solution created by the radiating ultrasonic waves.

Testing done in the early phases of designing the invention indicated that printing cylinders continually rotating through the ultrasonic radiation field, via non-manual means, were cleaned evenly and consistently in approximately 20–30 minutes.

By contrast, cylinders which were not continually rotated through the cavitation field, but rather, were periodically rotated manually, approximately every five minutes, were not evenly cleaned and generally took as much as 20 minutes longer to clean completely. Even in such cases, some streaking was evident on the cylinders' printing surfaces. Cylinders rotated manually with only a part of the cylinder immersed in the cleaning tank were never completely cleaned, since the surfaces of such cylinders tended to flash dry as the hot cleaning solution dried on the surface as the cylinder rotated, partially, outside of the liquid.

Figure 5:
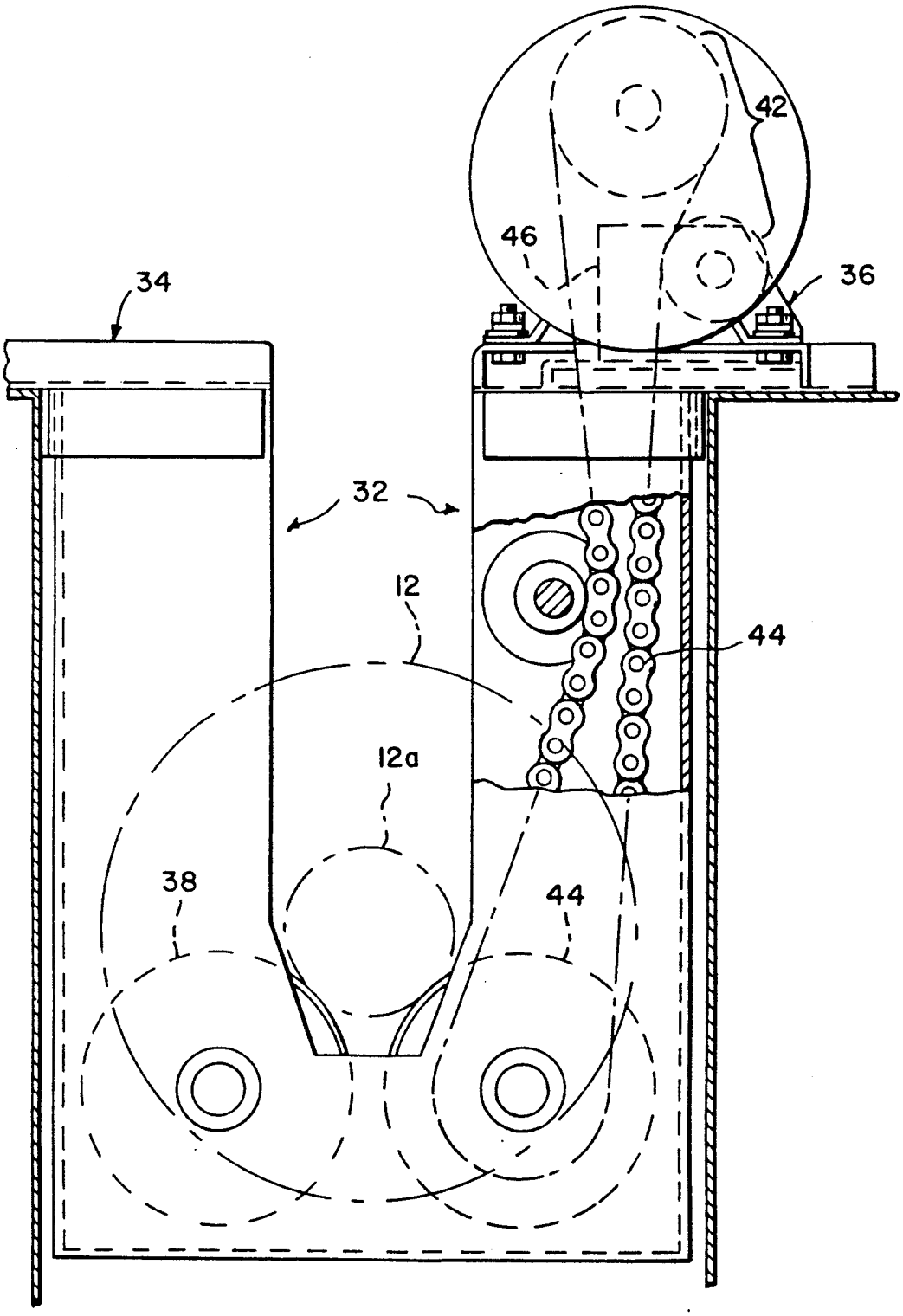
FIG. 5 is an elevational view, taken along line 5—5 of FIG. 2, of a preferred means for rotation of a printing cylinder during an ultrasonic cleaning within the cleaning apparatus of the invention.

A preferred rotation system which may be used in combination with the present invention is shown, in cross-section, in FIG. 5. The rotation means 32 preferably rests, unattached, on top of apparatus 20, has a stainless steel frame, and includes a drive end and an idler. More particularly, rotation means 32, as illustrated in FIG. 5, includes two fixtures 34, 36.

One fixture (34) is simply an idler fixture having, preferably, a stainless steel frame, and two free-spinning wheels 38 One free-spinning wheel being visible (in the cross-sectional view presented), preferably made of polyurethane, upon which the shaft **12*a* of printing cylinder 12 is to rest within cleaning tank 14**.

Rotation means 32, opposite idler fixture 34, includes a drive fixture 36, preferably having a stainless steel frame with two wheels 40 (one visible in the cross-sectional view of FIG. 5), preferably made of polyurethane. Wheels 40, like wheels 38, also support shaft **12*a* of printing cylinder 12; however, wheels 40 include a gear sprocket arrangement 42 and a drive chain 44 driven by an electric motor 46. The sprocket gear arrangement is preferably made of stainless steel, though other materials, such as polyurethane, may be used for this purpose. Upon operation, the electric motor activates gear sprocket arrangement 42 to move drive chain 44, which rotates wheels 40, 38. An endless loop drive belt 80 is placed around and in contact with said pair of wheels 38 and 40, and also contacts shaft 12***a* of printing cylinder 12, causing rotation of printing cylinder 12 in response to the rotation of the wheels.

Figure 6:
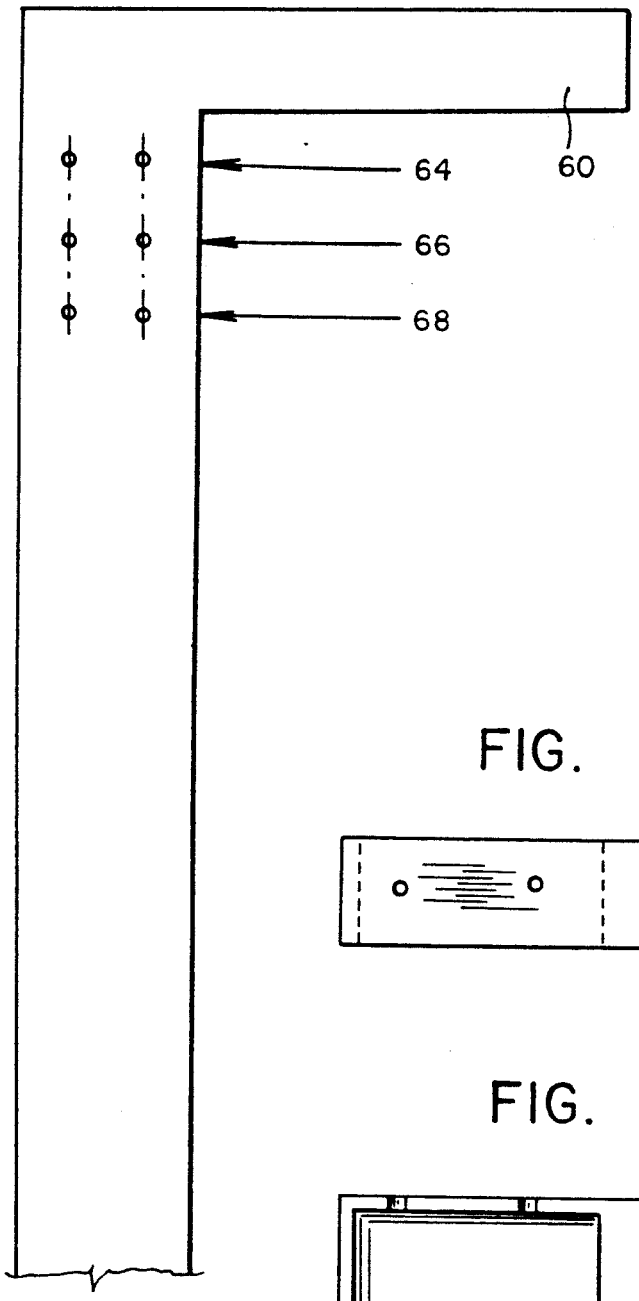
FIG. 6 is a side elevational view of an alternate embodiment of the positioning fixture.
Figure 7A:
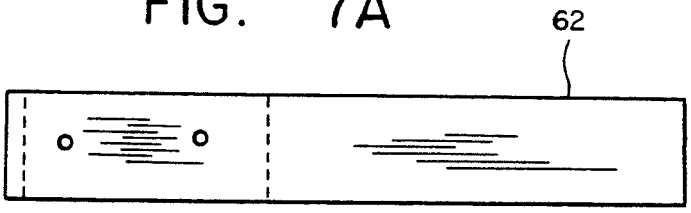
FIG. 7A is a side elevational view of an adjusting post to be used with the positioning fixture of FIG. 6.
Figure 7B:
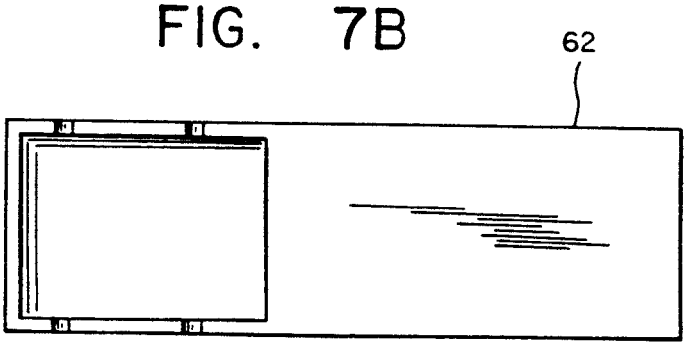
FIG. 7B is a top plan view of the adjusting post in FIG. 7A.
Figure 8:
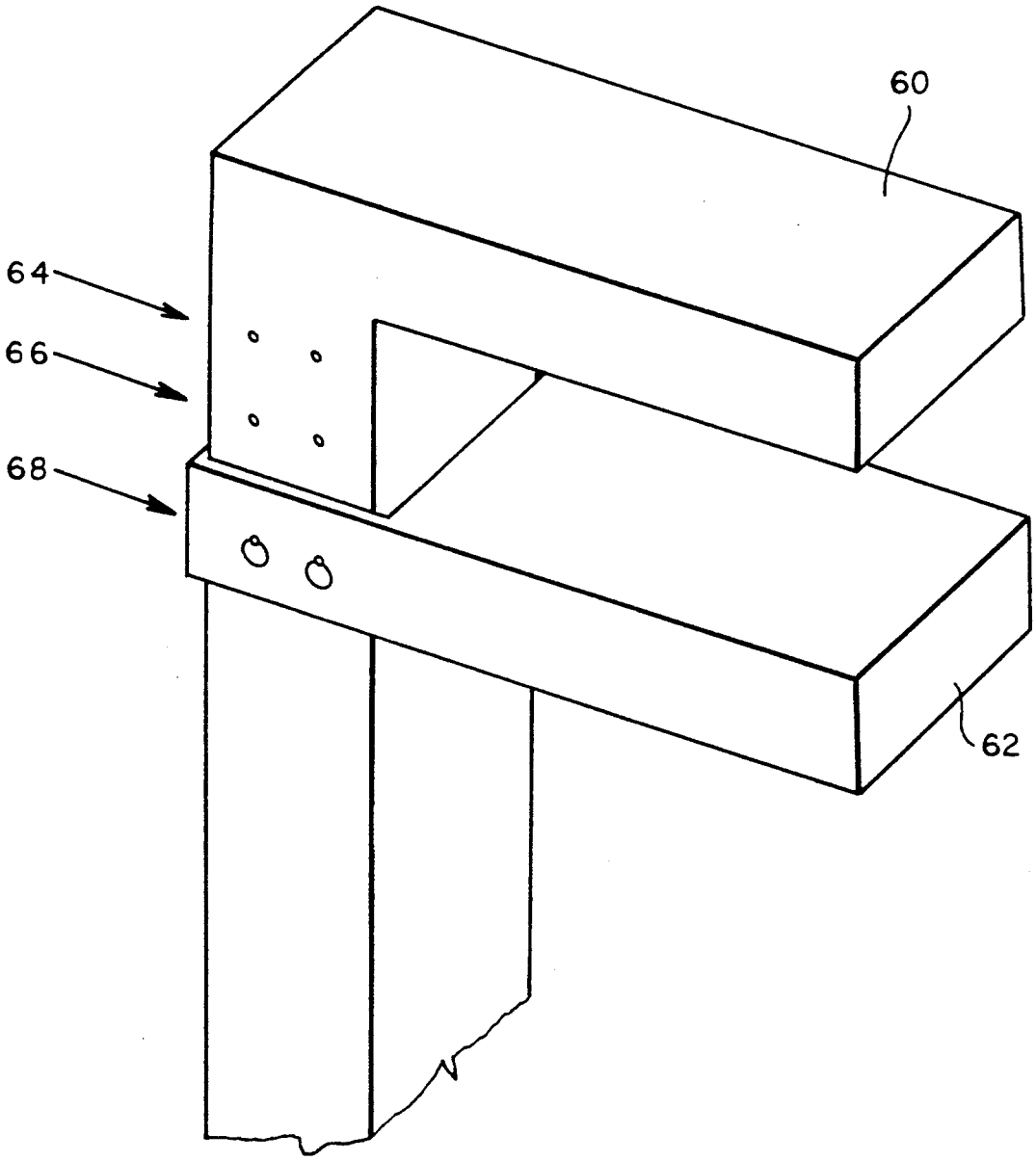
FIG. 8 is a perspective view of the positioning fixture shown in FIG. 6, detachably coupled to the adjusting post shown in FIG. 7.

Referring now to FIGS. 6, 7 and 8, there is illustrated an alternate embodiment for positioning fixture 30 shown as positioning fixture 60, which includes an adjusting post 62. As can be seen in FIG. 5, fixtures 34 and 36 are outwardly projecting fixed flanges which rest directly on cleaning tank 14 where transducer 26 lies. Shaft 12A of cylinder 12 to be cleaned rests in the bottom center section of the "V"-block arrangement. Thus, printing cylinder 12 rests a certain distance above transducer 26. If a different-sized printing cylinder is to be cleaned, the positioning fixture must be raised or lowered with respect to the bottom of tank 14, so as to maintain the distance between the printing cylinder surface and the transducer at a predetermined fixed distance (i.e., at least 3 inches). The apparatus shown in FIG. 8 is an alternate embodiment of the positioning fixture, provided for this purpose. Adjusting post 62, as seen in FIGS. 6, 7A, 7B and 8, is provided to rest on the upper lip of tank 14. If a large printing cylinder 12, for example, 14 inches in diameter, is to be cleaned, adjusting post 62 can be fastened to positioning fixture 60 at position 68 raising positioning fixture 60 with respect to the bottom of tank 14. If a smaller printing cylinder 12 is to be cleaned, for example, 10 inches in diameter, adjusting post 62 can be placed at position 66 on positioning fixture 60. Thus, positioning fixture 60 will be slightly lowered into the tank to bring printing cylinder 12 closer to the bottom of tank 14, where transducers 26 are located. Also, if a small printing cylinder 12 is to be cleaned, for example, 7 inches in diameter, adjusting post 62 can be fastened to positioning fixture 60 at position 64. Thus, positioning fixture 60 would be lowered still further into the tank, bringing printing cylinder 12 closer to the bottom of tank 14, where the transducers 26 are located.

Figure 9:
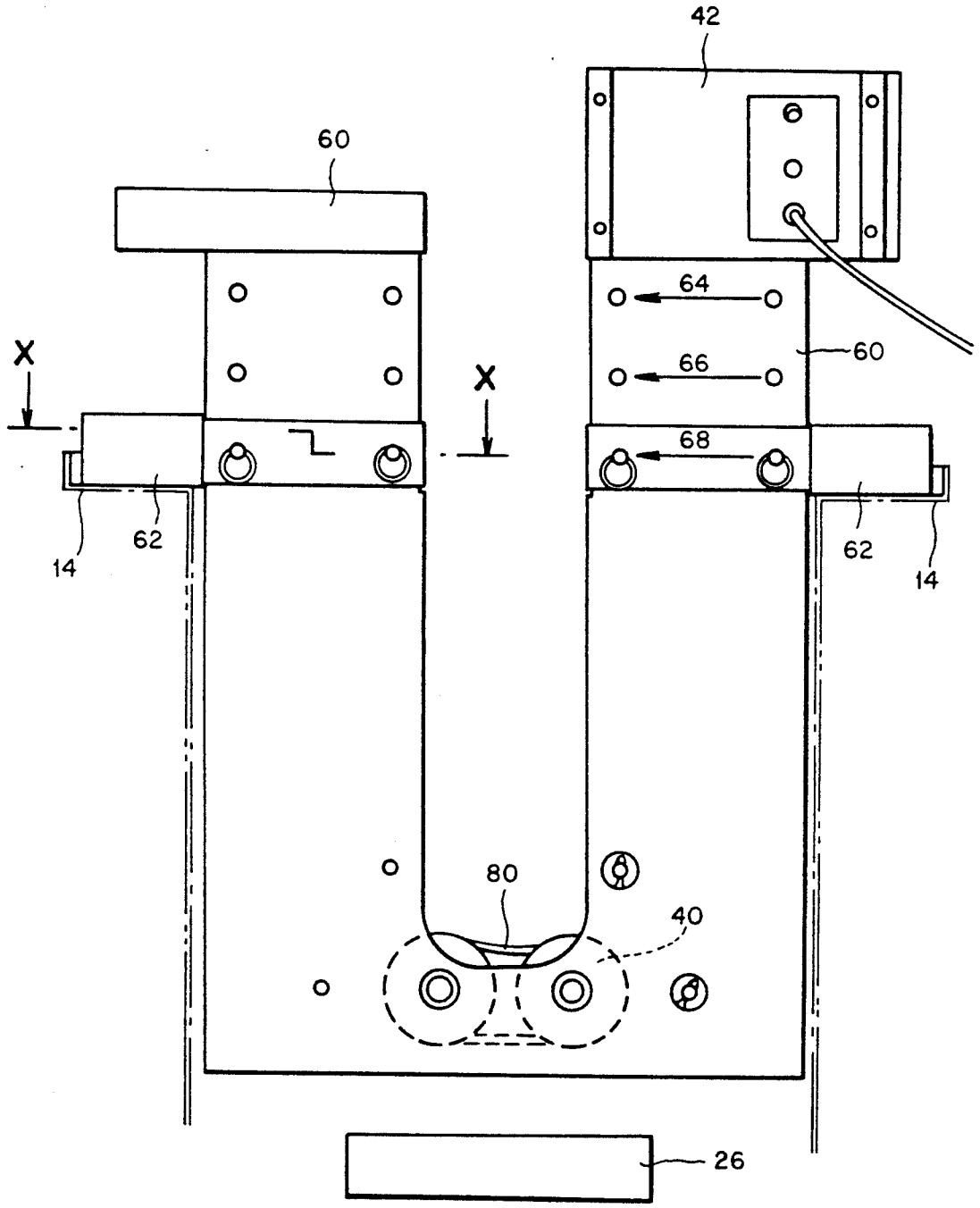
FIG. 9 is an elevational end view of the alternate positioning fixture and adjusting post shown in FIG. 8 mounted within the tank of the ultrasonic cleaning apparatus.

As can be seen in FIG. 9, adjusting post 62 can be fastened to positioning fixture 60 at positions 64, 66 or 68, for example. In the figure, position 64 in which the positioning fixture 60 is in its lowermost position can clean printing cylinders with diameters of six inches to eight inches, for example. Position 66, where positioning fixture 60 is in its intermediate position, roller diameters of, for example, nine inches to 12 inches can be cleaned. In position 68, positioning fixture 60 can clean printing cylinders with diameters of 13 inches to 16 inches, for example. It should, of course, be recognized that positioning fixture 60 can be modified to accommodate a wide range of roller diameters, all such modifications should be considered within the scope of the present invention.

Figure 10:
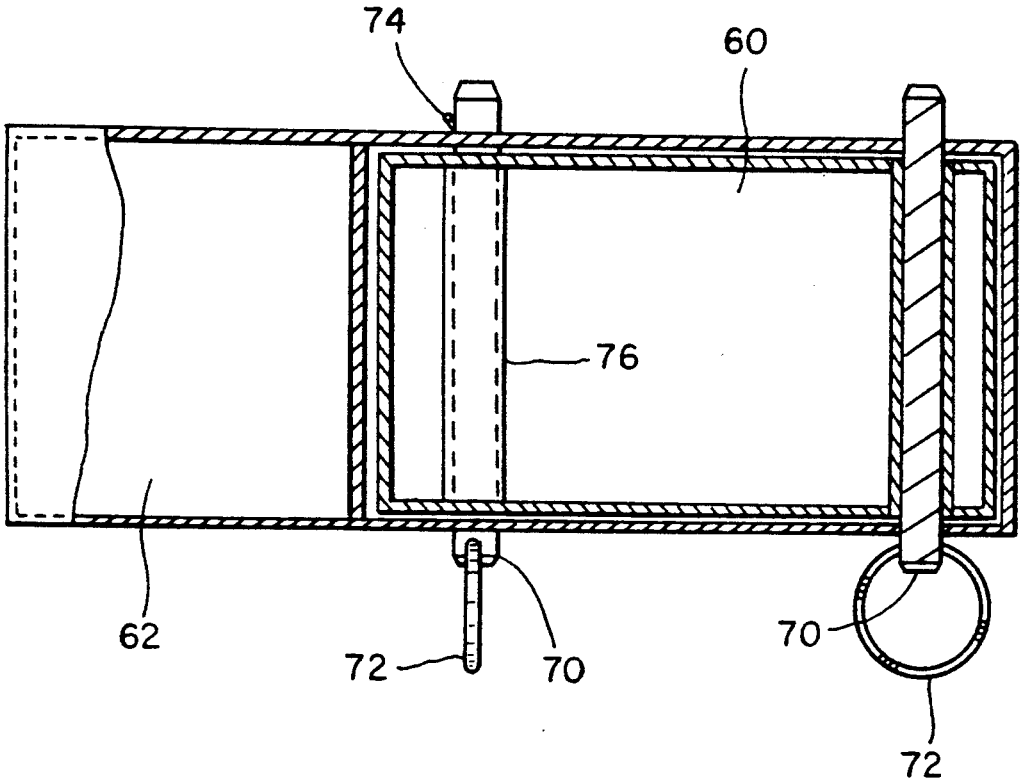
FIG. 10 is a cross-sectional view taken along line X—X of FIG. 9.

FIG. 10 shows a cross-sectional view of positioning fixture 60 and adjusting post 62 from FIG. 9. A pair of conventional quick-release pins 70 is provided which secure adjusting post 62 to positioning fixture 60 at positions 64, 66 or 68. In order to move adjusting post 62 to an alternate position, quick-release pins 70 are grasped by a ring 72 and pulled out of the adjusting post 62 and positioning fixture 60. When quick-release pins 70 are removed, a ball bearing 74 is compressed into the shaft of quick-release pins 70, allowing it to disengage from adjusting post 62 and positioning fixture 60. Once adjusting post 62 has been moved to its new location, quick-release pin 74 is reinserted into the holes provided. Positioning fixture 60 may be provided with a tube 76 which guides positioning pin 70 through the holes provided in positioning fixture 60. Quick-release pins 70 will thus be guided straight through the openings. Once fully inserted, the position as shown in FIG. 10, spring loaded ball bearings 70 pop out and keep quick-release pins 70 in place to prevent accidental disengagement. Appropriate force on ring 72 can overcome the force of spring loaded ball bearings 74, pushing it back into the shaft of quick-release pin 70 and allowing pin 70 to be engaged or disengaged.

It should be noted that the positioning fixture 60 and adjusting post 62 combination permit printing cylinder 12 to be raised or lowered in the tank without altering the distance from wheels 40 to gear sprocket arrangement 42. In other words, the entire rotation system remains fixed to positioning fixture 60, even though the entire positioning fixture 60 is moved relative to the bottom of tank 14. In this manner, printing roller 12, regardless of its diameter, always maintains the same number of revolutions per minute and the proper distance between printing roller 12 and transducer 26.

The printing cylinder should preferably be rotated through the generated ultrasonic wave field at a rotation of between 1–4 rpm. Testing has shown these rotation rates to be very effective. A slower rotation speed required, unnecessarily, a greater length of time to effect proper cleaning of the printing cylinder, while a faster rotational velocity did not effectively remove contaminants from the bottom of the ink cells in the face of the printing cylinder.

In designing and testing the apparatus of the invention, the rotation system was initially designed to rotate the cylinder on a roller bearing which rotated it in the printing press. The printing cylinder was turned quite easily as a flexible shaft was attached to one end of the printing cylinder shaft with a large magnet, while the opposite end of the cylinder shaft was driven by an electric motor. The system was cumbersome and worked to eventually clean the printing cylinder, although it had numerous problems. There were many shaft configurations which did not lend themselves to attachment of the magnetic means. In addition, different lengths of different cylinders required a changing of the length of the flexible shaft which, on occasion, would malfunction from too sharp of a bend radius and would sometimes come loose during rotation. This required the operator of the ultrasonic cleaning apparatus to attempt to reattach the magnet to the shaft. Since the shaft was not normally visible when submersed within the cleaning liquid, considerable dexterity and caution was necessary since the liquid temperature of the cleaning liquid was, generally, about 140° F.

The rotation means illustrated in FIG. 5 is non-magnetic, and has been found to overcome many of the drawbacks experienced by the flexible shaft/magnetic rotation means described immediately above. Both the preferred non-magnetic rotation means, and the magnetic means, however, have been found to be effective, albeit to varying degrees, in the apparatus of the present invention, and it should be understood that both are encompassed within the scope of the present invention.

While several embodiments of the present invention have been shown and described, it is to be understood that many changes and modifications may be made thereunto without departing from the spirit and scope of the invention as defined in the appended claims.

What is claimed is:

1. An apparatus for cleaning a printing cylinder with a cleaning liquid using ultrasonic waves, said printing cylinder having an outer face comprising:

a cleaning tank capable of containing therein the printing cylinder to be cleaned, and for receiving the cleaning liquid into which the printing cylinder is immersed during cleaning;

means for heating the cleaning liquid to be contained within said cleaning tank when the printing cylinder is being cleaned;

means for generating the ultrasonic waves;

means for maintaining a desired distance between said ultrasonic generating means and the outer face of the cylinder, said maintaining means including means for positioning the printing cylinder within said tank including adjusting means for raising and lowering said positioning means and the printing cylinder so that said means for generating is maintained at a distance of, at least, approximately three inches from the outer face of the printing cylinder to be cleaned;

non-magnetic means for rotating the printing cylinder within the cleaning liquid, within said cleaning tank, during cleaning;

said means for rotating the printing cylinder rotates the printing cylinder at a velocity of between 1–4 rpm.

2. The apparatus according to claim 1, wherein said means for generating includes a transducer mounted in said tank for radiating the ultrasonic waves generated by said means for generating into the cleaning liquid when the printing cylinder is being cleaned.

3. The apparatus for cleaning a printing cylinder according to claim 1, additionally including a feeder mechanism for placement of the printing cylinder within said cleaning tank prior to cleaning and for removal from said cleaning tank once cleaning of the printing cylinder is completed.

4. The apparatus for cleaning a printing cylinder according to claim 2, wherein said adjusting means includes an adjusting post, positioning fixture and locking means, said locking means locking said adjusting post at a pre-determined position along said positioning fixture, the pre-determined position corresponding to a particular depth of the printing cylinder with respect to said transducer.

5. The apparatus for cleaning a printing cylinder according to claim 4, wherein said adjusting post has a plurality of vertically spaced apart holes; and wherein said locking means includes locking pins which pass through said holes located in said adjusting post and through one of several corresponding holes located in said positioning fixture.

6. The apparatus for cleaning a printing cylinder according to claim 1, wherein said means for heating the cleaning liquid within said cleaning tanks heats and maintains the temperature of the cleaning liquid below 185° F.

7. The apparatus for cleaning a printing cylinder according to claim 1, wherein the ultrasonic waves generated by said generating means have an ultrasonic frequency between 20–40 kHz.

8. The apparatus for cleaning a printing cylinder according to claim 1, wherein said means for generating the ultrasonic waves is capable of being immersed in the cleaning liquid used for cleaning the printing cylinder, said means for generating having a power output of approximately 5–6 watts per square inch of irradiating surface.

9. The apparatus for cleaning a printing cylinder according to claim 1, wherein said non-magnetic means for rotating includes means for activating a gear sprocket arrangement for rotating a plurality of drive wheels which, in turn, each rotate an end shaft of the printing cylinder, said non-magnetic means for rotating further including a plurality of idler wheels which each contract an end shaft of the printing cylinder being rotated.

10. The apparatus for cleaning a printing cylinder according to claim 1, further comprising means for filtering the cleaning liquid contained within said cleaning tank during cleaning of the printing cylinder.

11. The apparatus for cleaning a printing cylinder according to claim 1, wherein said cleaning tank includes a low-level liquid sensor for terminating the cleaning of the printing cylinder when the level of the cleaning liquid falls below a pre-determined level.

12. The apparatus for cleaning a printing cylinder according to claim 1, wherein said means for generating the ultrasonic waves is maintained at a distance of 3–5 inches from the surface of the printing cylinder.

13. The apparatus for cleaning a printing cylinder according to claim 1, wherein said means for positioning is a generally V-shaped rack including tank support means for supporting said rack; and printing cylinder support means, said tank support means supporting said rack and said printing cylinder support means so that the outer face of the printing cylinders is maintained at said distance of at least approximately 3 inches from said means for generating.

14. The apparatus for cleaning a printing cylinder according to claim 13, wherein said tank support means includes a pair of adjusting posts which extend outwardly from said rack in opposite directions from each other and which rest upon said cleaning tank.

15. The apparatus for cleaning a printing cylinder according to claim 14, wherein said printing cylinder support means includes a pair of wheels centrally located at the inner portion of the V-shaped rack, which cooperatively support the printing cylinder.

16. The apparatus for cleaning a printing cylinder according to claim 15, additionally including an endless loop drive belt which is placed around said pair of wheels and which is capable of supporting an end shaft of the printing cylinder.

* * * * *